United States Patent [19]

Lobbe

[11] 3,950,956

[45] Apr. 20, 1976

[54] DRIVING OF TUNNELS

[75] Inventor: Armin Lobbe, Oberaden, Germany

[73] Assignee: Gewerkschaft Eisenhutte Westfalia, Wethmar near Lunen, Germany

[22] Filed: Dec. 6, 1973

[21] Appl. No.: 422,384

Related U.S. Application Data

[62] Division of Ser. No. 180,961, Sept. 16, 1971, Pat. No. 3,818,713.

[30] Foreign Application Priority Data

Sept. 24, 1970 France ..... 70.34576

[52] U.S. Cl. ..... 61/85; 61/42

[51] Int. Cl.[2] ..... E01G 3/02

[58] Field of Search ..... 61/84, 85, 63, 42, 45; 299/11, 33

[56] References Cited

UNITED STATES PATENTS

| | | | |
|---|---|---|---|
| 834,745 | 10/1906 | Moir | 61/85 |
| 1,275,910 | 8/1918 | Hamilton | 61/85 |
| 1,814,852 | 7/1931 | Proctor | 61/85 |
| 1,855,466 | 4/1932 | Barber et al. | 61/85 |
| 2,208,608 | 7/1940 | Stanley | 61/85 |
| 3,339,980 | 9/1967 | Winberg | 299/33 |
| 3,407,609 | 10/1968 | Kosogorin | 61/85 X |
| 3,413,811 | 12/1968 | Giacobino | 61/85 X |
| 3,581,507 | 6/1971 | Stevens | 61/85 |
| 3,613,384 | 10/1971 | Jacobs | 61/85 |
| 3,650,116 | 3/1972 | Cunningham | 61/85 |

*Primary Examiner*—Dennis L. Taylor

*Attorney, Agent, or Firm*—Sughrue, Rothwell, Mion & Zinn

[57] ABSTRACT

An apparatus for driving a tunnel, the apparatus having a knife shield composed of a circular array of elongate knife implements supported by a frame and attachable to a drive frame which can be moved to cause the implements to penetrate into a working face in order to excavate material therefrom. To the rear of the knife shield there is an advanceable temporary lining composed of tube sections arranged end-to-end and designed to support the newly-formed tunnel. This advanceable lining extends into a rear shield composed of a rearwardly extending portion of the implements lined with plank members.

A tubular revetment has a flange which abuts the advanceable lining at the side remote from the knife shield and fluid concrete is inserted around the periphery of the revetment to form a permanent tunnel lining, separated from the advanceable lining by the flange. The advanceable lining and the revetment are moved up from time to time as the driving progresses.

2 Claims, 4 Drawing Figures

II
II
IV
IV
1
2
3
4
5
6
7
8
9
11
12
13
14
15
16
17
18
19
23
24
25
26
28

DRIVING OF TUNNELS

This is a division of application Ser. No. 180,961, filed Sept. 16, 1971.

BACKGROUND OF THE INVENTION

The present invention relates generally to a method of, and apparatus for, driving tunnels, galleries, trenches and the like excavations.

In order to drive a tunnel it is known to use the so-called "knife-shield" apparatus such as is described in German Utility Patent No. 1 910 987. The apparatus has a frame bearing plank-shaped knives mounted adjacent to one another on the top of the frame. Each knife is associated with a double-acting hydraulic piston and cylinder unit disposed between the frame and the knife in question, so that each knife can penetrate into the ground material in a forward direction. As each knife advances, the frame is secured in position by the frictional resistance between the other knives and the surrounding material. When all the knives have been advanced, the simultaneous application of pressure fluid to all the hydraulic units in a reverse sense causes the frame to be moved forward. When apparatus of this type is used for driving a tunnel, a concreting operation, performed to fabricate a permanent tunnel lining, usually takes place immediately to the rear of the frame. This presents a serious draw-back, because in the same area of the tunnel in which concreting is to be performed, the material extracted has to be removed.

Hence, to avoid hinderance, these operations are usually performed in separate cycles, which is excessively time consuming.

Apparatus is also known which produces tunnels or galleries by utilizing metal tubes of limited thickness to form a temporary support lining for the tunnel. In this form of apparatus, the actual excavation or driving has to be effected by means of manually operated tools or knives, as a knife shield of the aforementioned type which requires an adequate support means cannot be used.

A general object of the present invention is to provide an improved method and apparatus for driving tunnels or the like.

SUMMARY OF THE INVENTION

According to the invention there is provided apparatus for forming tunnels or the like; said apparatus comprising a knife shield composed of a plurality of movable elongate implements each provided with a cutting portion, a drive frame to which said implements can be selectively connected, a support frame for supporting said implements, means for effecting relative movement between the drive frame and the support frame in the longitudinal direction of the implements so as to cause at least some of the implements to excavate material, a plurality of tube sections arranged end-to-end to form an advanceable tunnel lining for supporting the wall of the tunnel adjacent the knife shield, and a revetment disposed adjacent said advanceable lining and remote from the knife shield, said revetment being adapted to define a space for the introduction of concrete to form a permanent tunnel lining.

Further, according to the invention there is provided a method of driving a tunnel or the like, said method comprising the steps of driving a knife shield composed of elongate cutting implements into material to be removed supporting the wall of the tunnel produced by said implements with tube sections arranged end-to-end forming an advanceable lining, inserting concrete into a space defined by a revetment located at the rear of said advanceable lining to form a permanent tunnel lining, and advancing said revetment when the concrete has set.

In general, the invention combines the advantages of using a knife shield and of using an advanceable lining to support the wall of the tunnel prior to the construction of the permanent concrete lining. The concreting operation can thus be carried out at a sufficient distance from the excavation site to prevent the driving operation and the concreting operation from interfering with or impeding one another. In accordance with the invention, it is possible to effect the concreting operation at least partly during the time that the driving operation is effected, which enables the tunnel to be formed more quickly.

The cross section of the tunnel may take any desired form-e.g., circular or ogival, in which case, the knife shield is shaped in a corresponding manner to directly shape the tunnel. In an alternative version, however, a calotte-shaped or arcuate-shaped shield can be adopted which moves behind auxiliary units which preferably drive and concrete two side adits which can form the lateral walls of the finished tunnel. The shield then completes the driving of the entire cross section of the tunnel.

The invention may be understood more readily and various other features of the invention may become more apparent from consideration of the following description.

BRIEF DESCRIPTION OF DRAWINGS

Embodiments of the invention will now be described by way of example only, with reference to the accompanying drawings, wherein.

DESCRIPTION OF PREFERRED EMBODIMENTS

Figures 1, 2, 3, 4:
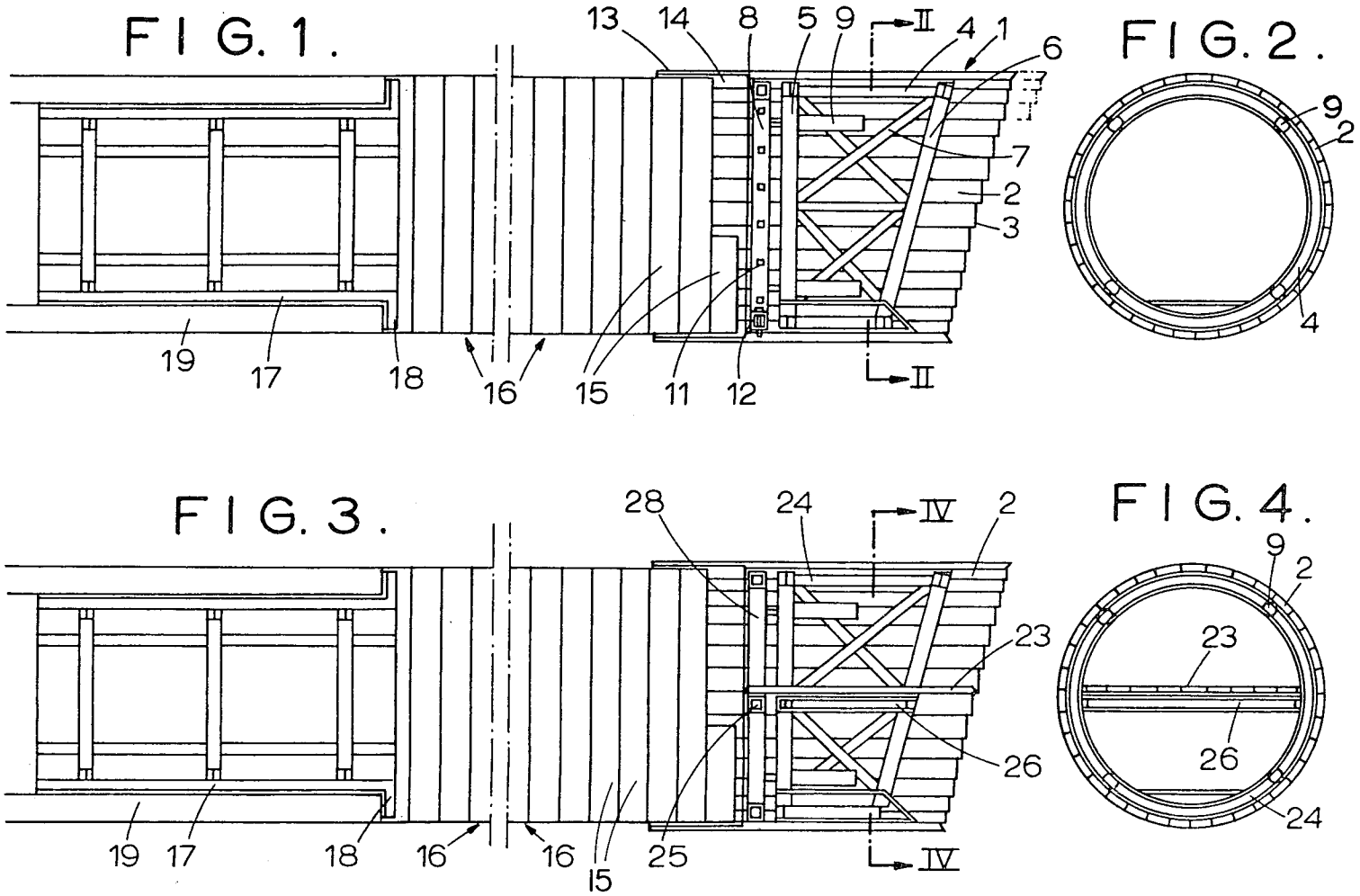
FIG. 1 is a schematic side elevation of an apparatus made in accordance with the present invention.
FIG. 2 is a cross-sectional view of the apparatus shown in FIG. 1, the view being taken along the line II—II of FIG. 1.
FIG. 3 is a schematic side elevation of another form of apparatus made in accordance with the present invention.
FIG. 4 is a cross-sectional view of the apparatus shown in FIG. 3, the view being taken along the line IV—IV of FIG. 3.

Referring initially to FIGS. 1 and 2, there is shown a tunnel driving apparatus which is formed at its foremost end with a knife shield generally designated 1. This knife shield 1 is composed of a circular array of elongated implements 2 each provided with a cutting portion 3 at the outwardly facing end thereof. Each implement 2 is movable in a longitudinal direction independently of the remaining implements 2. The implements 2 are carried or supported by a frame 4 composed of a rear upright member 5, a front inclined member 6, and intermediate struts 7.

A drive frame 8 which is movable in relation to the frame 4 is disposed rearwardly of the latter. A number, in this case four, of hydraulic piston and cylinder units 9 are connected between the frames 4,8 to effect relative movement therebetween. A pump for charging these units 9 can be mounted on the frame 4. The frame 8 has a ring provided with apertures 11 permitting the implements 2 to be secured to the frame 8 with the aid of locking pins 12.

The rearmost portions of the implements 2 form a rear shield generally designated 13. This rear shield 13 is lined with plank members 14 and defines a space into which can be inserted tube sections 15 which are arranged end-to-end to form a lining 16 for the wall of the tunnel excavated by the apparatus. As the apparatus, more particularly the shield 1, advances, fresh tube sections 15 would be installed.

At some distance rearwardly of the shield 13, there is a tubular revetment 17. The revetment 17 is relatively short in comparison to the distances between the revetment 17 and the shield 13, which distance may be, for example, 30 to 50 meters. The revetment 17 has clamping devices therein and is provided with a flange 18 which abuts the first of the tube sections 15. Fluid concrete would be introduced into the space 19 around the revetment 17, and the revetment 17 would be advanced towards the apparatus when the concrete has set.

The operation of the apparatus is as follows:

One or a group of members 2 are secured to the frame 8 with the aid of the pins 12, and the hydraulic units 9 are operated in order to advance the frame 8 towards the frame 4 to thereby cause the member or members 2 to penetrate into the material at the working face. The member or members 2 are detached from the frame 8, and the hydraulic units 9 are operated to bring the frame 8 back to its former position. One or more further members 2 are attached to the frame 8, which is again advanced as described above. The fresh member or members are detached from the frame 8, and the latter is again brought back to the initial position to commence another operating cycle. The sequence is repeated until all the members 2 have been driven into the face so as to cut a cylindrical section of material from the working face. This material is removed in known manner, and the frame 4 is re-sited before a fresh operating cycle is commenced. At each advance of the shield 1 in the manner described, a fresh tube section 15 is installed so as to maintain the lining 16 within the rear shield 13, and the revetment 17 is similarly advanced. It is advantageous that the actual driving or excavating operation and the concreting operation is carried out remotely and independently from one another, thereby preventing one operation from interfering with the other and enabling these operations to be carried out simultaneously or at least partly concurrently.

The apparatus shown in FIGS. 3 and 4 has like reference numerals denoting like parts to those of FIGS. 1 and 2. In the apparatus shown in FIGS. 3 and 4, the drive frame is denoted 28 and the support frame is denoted 24. In distinction to the corresponding frames 4,8 in the apparatus shown in FIGS. 1 and 2, the frames 24,28 have transverse elements 25,26 located at the horizontal centre of the frames 24,28. The elements 25,26 support additional elongate implements 23 formed with cutting portions at the outermost ends. These implements 23 are moved in groups or in toto to facilitate the excavation of the material.

I claim:

1. A method of driving a tunnel or the like, said method comprising the steps of:

a. driving a knife shield composed of elongate cutting implements into material to be removed;

b. inserting a tube section into a space defined by a rear shield attached to said knife shield when said knife shield has advanced sufficiently to permit the insertion of said tube section, said tube section being of a size to support the wall of the tunnel produced by said implements after said knife shield and said rear shield have been advanced beyond said tube section;

c. repeating the previous step so as to form an advanceable lining of tube sections arranged end-to-end;

d. inserting concrete into a space defined by a revetment located at the rear of said advanceable lining to form permanent tunnel lining, the inserting of the concrete being effected independently of the driving of said knife shield; and e. removing the rearmost tube sections and advancing said revetment when the concrete is set.

2. A method according to claim 1, wherein the concreting operation is effected at least partly during the time that the driving operation is effected.

* * * * *